US005833019A

United States Patent [19]

Gynz-Rekowski

[11] Patent Number: 5,833,019

[45] Date of Patent: Nov. 10, 1998

[54] PIPE PROTECTOR

[75] Inventor: Gunther V. Gynz-Rekowski, Houston, Tex.

[73] Assignee: Pegasus International Inc., Georgetown, Cayman Islands

[21] Appl. No.: 756,382

[22] Filed: Nov. 27, 1996

[51] Int. Cl.[6] ..... E21B 17/00

[52] U.S. Cl. ..... 175/325.6; 166/241.6

[58] Field of Search ..... 175/320, 325.1, 175/325.3, 325.4, 325.5, 325.6; 166/241.6, 241.7, 173

[56] References Cited

U.S. PATENT DOCUMENTS

| | | | |
|---|---|---|---|
| 2,079,449 | 5/1937 | Haldeman . | |
| 2,308,316 | 1/1943 | Smith et al. . | |
| 2,318,878 | 5/1943 | Miller . | |
| 2,368,415 | 1/1945 | Grant . | |
| 2,572,307 | 10/1951 | Brown et al. . | |
| 2,650,798 | 9/1953 | Stohn . | |
| 2,715,552 | 8/1955 | Lane . | |
| 2,813,697 | 11/1957 | Swart . | |
| 2,829,864 | 4/1958 | Knapp . | |
| 2,860,013 | 11/1958 | Medearis . | |
| 3,063,759 | 11/1962 | Moore et al. . | |
| 3,088,532 | 5/1963 | Kellner . | |
| 3,154,156 | 10/1964 | Moore et al. . | |
| 3,227,498 | 1/1966 | Leathers . | |
| 3,320,004 | 5/1967 | Garrett . | |
| 3,397,017 | 8/1968 | Grant et al. . | |
| 3,410,613 | 11/1968 | Kuus . | |
| 3,419,094 | 12/1968 | Bobo . | |
| 3,425,757 | 2/1969 | Minor . | |
| 3,449,022 | 6/1969 | Minor . | |
| 3,476,196 | 11/1969 | Whittle et al. . | |
| 3,480,094 | 11/1969 | Morris . | |
| 3,482,889 | 12/1969 | Cochran . | |
| 3,499,210 | 3/1970 | Schellstede et al. . | |
| 3,528,499 | 9/1970 | Collett . | |
| 3,545,825 | 12/1970 | Hamilton . | |
| 3,588,199 | 6/1971 | Hompans . | |
| 3,592,515 | 7/1971 | Grant . | |
| 3,612,627 | 10/1971 | Fuller | 175/325.6 |
| 3,667,817 | 6/1972 | Kellner . | |
| 3,675,728 | 7/1972 | Faulk et al. . | |
| 3,709,569 | 1/1973 | Napper . | |
| 3,894,779 | 7/1975 | Hoon et al. . | |
| 3,894,780 | 7/1975 | Broussard | 175/325.6 |
| 3,933,395 | 1/1976 | Evans . | |
| 3,999,811 | 12/1976 | Gray . | |
| 4,000,549 | 1/1977 | Brumley et al. | 175/325.5 |
| 4,059,164 | 11/1977 | Farris . | |
| 4,071,101 | 1/1978 | Ford . | |
| 4,083,612 | 4/1978 | Olson . | |
| 4,108,256 | 8/1978 | Moore, III . | |
| 4,199,853 | 4/1980 | Fricker . | |
| 4,220,213 | 9/1980 | Hamilton . | |

(List continued on next page.)

FOREIGN PATENT DOCUMENTS

WO 95/10685 4/1995 WIPO .

OTHER PUBLICATIONS

Extending Horizontal Drilling Reach, *Journal of Petroleum Technology,* Aug. 1996, 738–740.

Rodman, David William, et al., Drillstring sub cuts torque and casing wear, *Oil & Gas Journal,* Oct. 1996, 64–72.

Bettis Rubber Products Bulletin, 1993, 1–13.

Regal Drill Pipe/Casing Protectors, date unknown, 4 pages.

Weatherford Enterra, Drill/Pipe Casing Protectors, Aug. 8, 1996, 2 page.

*Primary Examiner*—William P. Neuder

*Attorney, Agent, or Firm*—Rosenblatt & Redano, P.C.

[57] ABSTRACT

A casing/drillpipe protector is disclosed that has a composite structure made up of two separate parts. Both parts have cages to secure skeleton functions. The inner part is nested within the outer part such that the open ends of both cages form loops which can be aligned for insertion of a pin to secure the protector to the pipe. The cage of the inner part is smaller but stronger than the cage of the outer part and provides the significant portion of the hoop stress, and therefore radial force of the protector which is used to retain it to the drillpipe.

21 Claims, 5 Drawing Sheets

U.S. PATENT DOCUMENTS

| | | |
|---|---|---|
| 4,266,578 | 5/1981 | Swain et al. . |
| 4,284,154 | 8/1981 | England . |
| 4,372,622 | 2/1983 | Cheek . |
| 4,381,821 | 5/1983 | Greene, Jr. . |
| 4,384,625 | 5/1983 | Roper et al. . |
| 4,384,747 | 5/1983 | Hodge . |
| 4,394,881 | 7/1983 | Shirley . |
| 4,399,876 | 8/1983 | Tienari . |
| 4,484,785 | 11/1984 | Jackson . |
| 4,665,996 | 5/1987 | Foroulis et al. . |
| 4,665,997 | 5/1987 | Maurer et al. . |
| 4,796,670 | 1/1989 | Russell et al. . |
| 4,823,891 | 4/1989 | Hommani et al. . |
| 4,832,137 | 5/1989 | Walker . |
| 4,865,138 | 9/1989 | Swietlik . |
| 4,995,466 | 2/1991 | Snow, Jr. . |
| 5,052,501 | 10/1991 | Wenzel et al. . |
| 5,058,689 | 10/1991 | Collingsworth . |
| 5,069,297 | 12/1991 | Krueger et al. . |
| 5,090,500 | 2/1992 | Yousef et al. . |
| 5,117,927 | 6/1992 | Askew . |
| 5,174,679 | 12/1992 | Wolf . |
| 5,339,910 | 8/1994 | Mueller . |
| 5,458,208 | 10/1995 | Clarke . |
| 5,579,854 | 12/1996 | Barry ..... 175/325.6 X |

PIPE PROTECTOR

FIELD OF THE INVENTION

The field of the invention relates to protective clamp-on devices for tubulars and especially for casing, tubing, and drillpipe of oil, gas, and water wells to eliminate casing and drillpipe wear, to reduce torque and drag in boreholes, to decrease the drillstring fatigue, and to provide a stabilizing effect which ensures a straighter, more uniform borehole.

BACKGROUND OF THE INVENTION

During drilling, the drill string rotates in the wellbore. Wear patterns, a reduced O.D., and eccentric U-joint shapes occur on the drillstring due to rotation of the string, particularly in deviated wellbores, which are partially or totally cased. The drillstring rubs against the casing as the bit is rotated from the surface, which is called the rotary mode. Various protection devices have been applied to the drillstring in the past in an attempt to reduce wear, not only on the drillpipe but also on the casing in the well. The utilization of drillpipe/casing protectors is needed, especially for extended reach applications where casing sections have to be replaced if drillpipe protectors were not available. Drillpipe/casing protectors have been used to reduce torque and drag. In some applications, like the extended reach, high torques are required for drillstring rotation. When rubbing resistence occurs near the bit, which happens in all deviated wells, the drillpipe tends to corkscrew in the hole, which adds to wear. These types of protectors are also intended to reduce drillstring fatigue due to a shock-absorbing effect which will reduce shock loads and enhance the endurance limits for all downhole components. The protectors also exhibit a stabilizing effect which promotes a straighter and more uniform borehole. Such protectors have also been used in risers on drill ships and semisubmersibles to reduce abrasion within the riser.

A variety of designs have been used in the past. An annularly shaped protector, which is stretched over the end of the pipe and generally made out of a rubber compound or some other wearing material, is but one type that has been used. This design is difficult to apply and tended to break loose and sag down to the next lower joint as opposed to staying where it was initially installed when subjected to downhole environments. Other designs employed rubber coupled with a metallic cage where the cage had a single joint involving loops which would be aligned and the protector would be secured to the pipe by driving a pin through the aligned loops. The first group mentioned, that slip over the pipe, are more commonly known as stretch-on protectors and are mainly made by Bettis Corporation, now a part of Hydril Corporation. Other manufacturers also make drillpipe and casing protectors. Some of those companies are Weatherford Enterra and Partex, as well as Bettis. Drillpipe protectors are also illustrated in U.S. Pat. Nos. 3,709,569; 3,425,757; 3,592,515; 3,588,199; 3,480,094; 3,667,817; and 3,675,728. Also of general interest in the area of stabilizers, pipe protectors, and techniques for installing them on drillpipe are U.S. Pat. Nos. 3,545,825; 3,499,210; and 3,482,889.

Yet other designs, such as those made by Regal Corporation of Corsicana, Texas, and sold as the "Star King" and "Slick" models, involve using a hinged cage which closes with a long tapered pin driven into the latch mechanism, which comprises a series of aligned loops generally located 180° from the hinged joint. Typically, the tapered pin is driven with a hammer. The reason a hinge is put in the can or cage or the metallic backing for the rubber component of the protector is that in an effort to increase the grip of the prior protectors, the technique that had developed was to make the cages stronger. However, if the cages were made stronger to increase the radial force over the circumference applied by the protector to the pipe without a hinge, the stronger cages precluded easy installation because the open end could not be simply spread far enough to go around the pipe and then be drawn again tightly over the pipe.

As a compromise between durability and strength, some prior cages had a wavy, fluted or corrugated appearance to give the cage spring-like tendencies which allowed storage of potential spring-like energy. These types of pipe protectors are more forgiving of O.D. tolerances of the tubulars and pipes. The current standard pipe protector cage is designed with openings like holes and slots to enhance the bonding effect of rubber and cage. The problems with this design are the creation of stress concentration points which after a fairly short usage resulted in stress cracking at these openings due to reduced endurance limits. Weatherford Enterra developed an extremely low-friction pipe protector with a seven- to ten-fold less friction factor than commonly used. However, these low friction factors will reduce in the same manner the slip force if no other measures are taken. Therefore, Weatherford Enterra used corrugated cages without openings by which the materials used are very high elongation steels.

Thus, the prior designs struggled with the trade-off between the need to get as much radial force around the pipe from the protector as possible to prevent slipping, balanced against the increasing difficulty of assembly that ensued by making the cages stronger. Accordingly, an object of the present invention is to provide a design which facilitates both objectives. The composite design as disclosed creates significantly higher hoop stresses and radial forces and, therefore, higher slip forces from the overall protector; yet at the same time does not unduly add to the driving force required to insert the pin to close the latch around the pipe. Another objective of the present invention is to provide a design which incorporates shock absorption on the stressed member that provides the bulk of the radial forces holding the protector to the pipe. Another object is to increase the friction factor between the protector to the pipe to enhance the probability that the protector will retain its position in use. Yet another objective is to configure the outer periphery of the protector to have wear plates or pads of varying design, which improve its life and reduce the tendency for hanging up on insertion and removal of the drillpipe.

SUMMARY OF THE INVENTION

A casing/drillpipe protector is disclosed that has a composite structure made up of two separate parts. Both parts have cages to secure skeleton functions. The inner part is nested within the outer part such that the open ends of both cages form loops which can be aligned for insertion of a pin to secure the protector to the pipe. The cage of the inner part is smaller but stronger than the cage of the outer part and provides the significant portion of the hoop stress, and therefore radial force of the protector which is used to retain it to the drillpipe. The outer cage is embedded in a wearing component like rubber, elastomer, plastic, or metal. The composite structure itself and the wearing component of the outer part adds a shock-absorbing quality to the assembly, insulating the inner cage from shock and vibration loadings to the wear element resulting from contact with the casing or open borehole. The rubber or other resilient material of the outer part has a much lesser friction factor than the material of the inner part which will give a high slip force on the drillpipe and secure low friction between the O.D. of the pipe protector and the casing or borehole wall.

The cage of the inner part can be embedded in rubber, elastomer, plastic, or metal like the outer cage but can also be exclusively by itself and can be coated with high friction materials. Torsional loading applied to the outer part will be transmitted throughout the pin to the inner part. The rubber or other resilient material between the inner and outer cages can also be configured in an interlocking tooth arrangement to aid in maintaining the relative positions of the inner and outer parts when reacting to applied torsional loads to the wearing member. The outer part, which wears on contact with the casing or open hole, can be provided with one or more wear plates or pads which improve the longevity of the casing/drillpipe protector. The wear plates or pads can be configured to bend around corners so that they facilitate insertion and removal of the drillstring by minimizing hang-up of the wearing component upon insertion and removal by acting as skids.

DETAILED DESCRIPTION OF THE DRAWINGS

DETAILED DESCRIPTION OF THE PREFERRED EMBODIMENT

Figure 2:
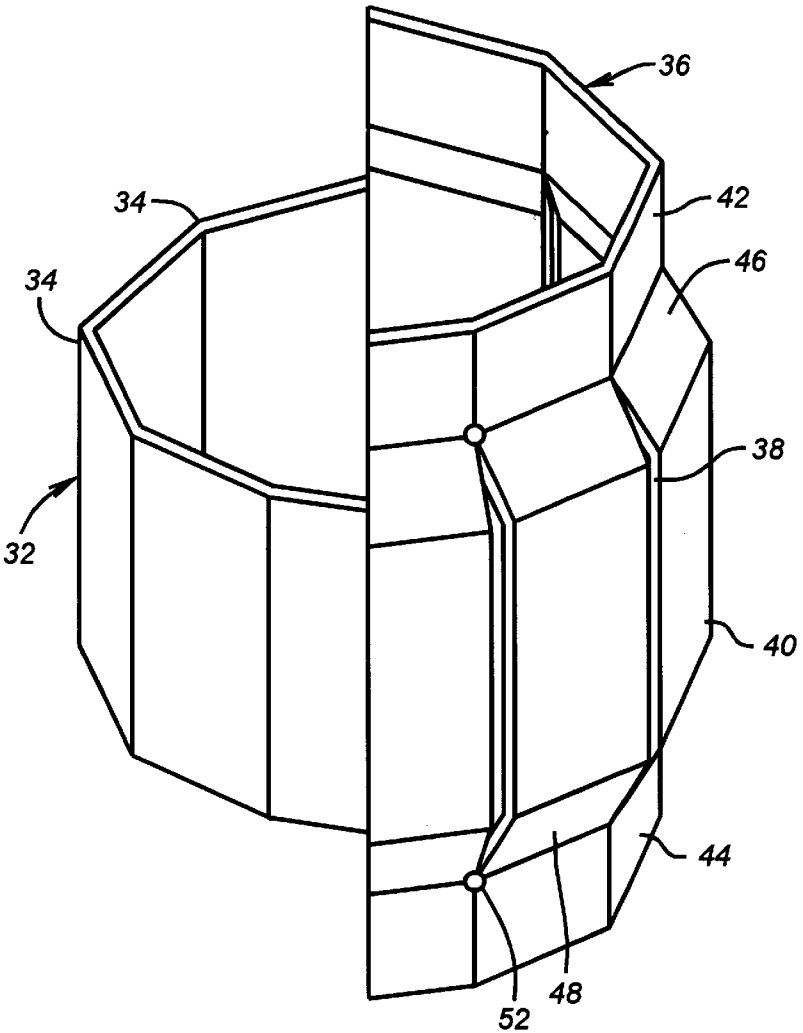
FIG. 2 is a cutaway perspective view of the cages without wearing component, showing the nesting relationship between them.
Figure 1:
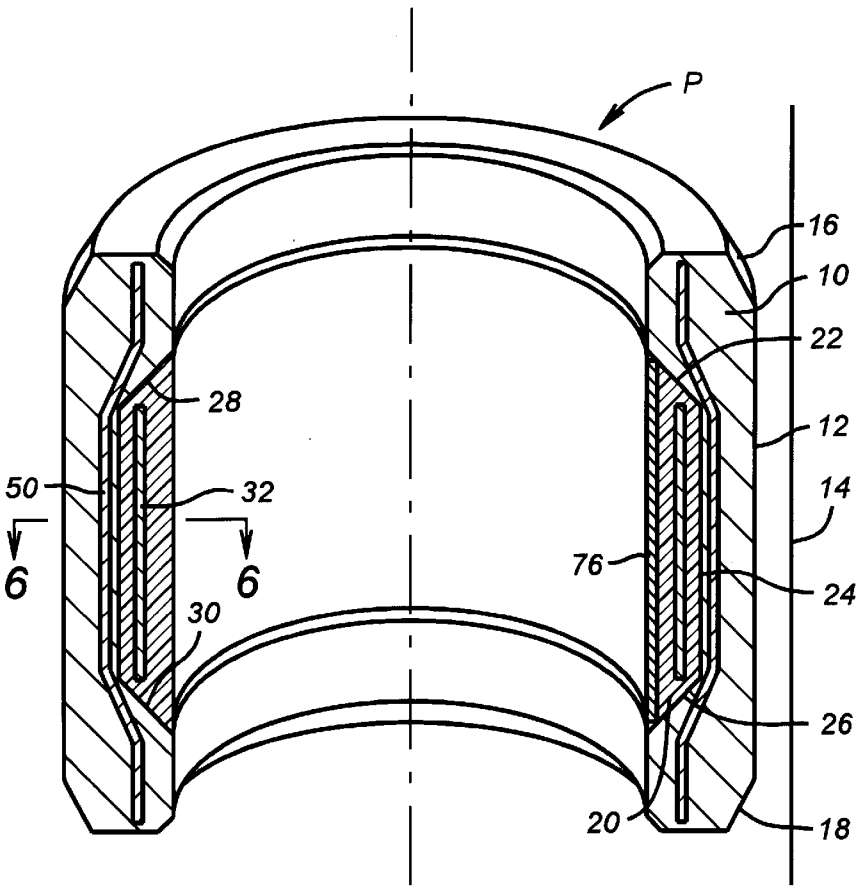
FIG. 1 is a sectional elevational view of the pipe protector illustrating on one-half the use of an optional elastomeric layer.

The preferred embodiment of the protector P is illustrated in FIG. 1. For clarity, the drillpipe, which is circumscribed by the protector P, is omitted so that the details of the protector P can be more readily seen. The protector P has an outer part that is called sleeve 10. Sleeve 10 has a main wear surface 12, which is substantially in alignment with the casing 14. To facilitate insertion and removal, tapered surfaces 16 and 18 are disposed, respectively, above and below wear surface 12. The bulk majority of the wear by design occurs at surface 12 as it contacts casing 14 when the drillstring (not shown) is rotated during drilling. Nested within outer sleeve 10 is a separate inner part which is called the inner sleeve 20. Inner sleeve 20 is an annular member, as is outer sleeve 10, and further comprises on its outer periphery surfaces 22, 24, and 26. Surface 24 can be parallel to wear surface 12 ,while the tapered surfaces 22 and 26 are preferably abutted to mating surfaces 28 and 30, respectively, on the inside of the outer sleeve 10. Embedded within the inner sleeve 20 is inner cage 32, which is shown in more detail in FIG. 2. Inner cage 32 has an annular shape which can be accomplished by bending flat plate into a ring-like structure, as illustrated in FIG. 2. Each of the bends 34 facilitate the fabrication of the shape as illustrated in FIG. 2. The outer cage 36 is embedded in outer sleeve 10. The construction of the outer cage 36 is best seen in FIG. 2. It is preferably formed from flat sheet that is scored to make a plurality of slits 38 to allow bending of components of cage 36 such that a central component 40 is substantially parallel to wear surface 12 but embedded within the wear component of the outer sleeve 10. Central component 40 extends beyond end segments 42 and 44 by virtue of tapered segments 46 and 48. Thus, by virtue of the protrusion of central component 40 beyond end pieces 42 and 44, tapers 28 and 30 (see FIG. 1) can be put into the outer sleeve 10 while still leaving a portion of sleeve 10, as indicated by numeral 50, between the outer cage 36 and the outer surface 24 of the inner sleeve 20. A series of holes 52 can be put at the edges of slits 38 to reduce stress concentration at that transition point.

Figure 3:
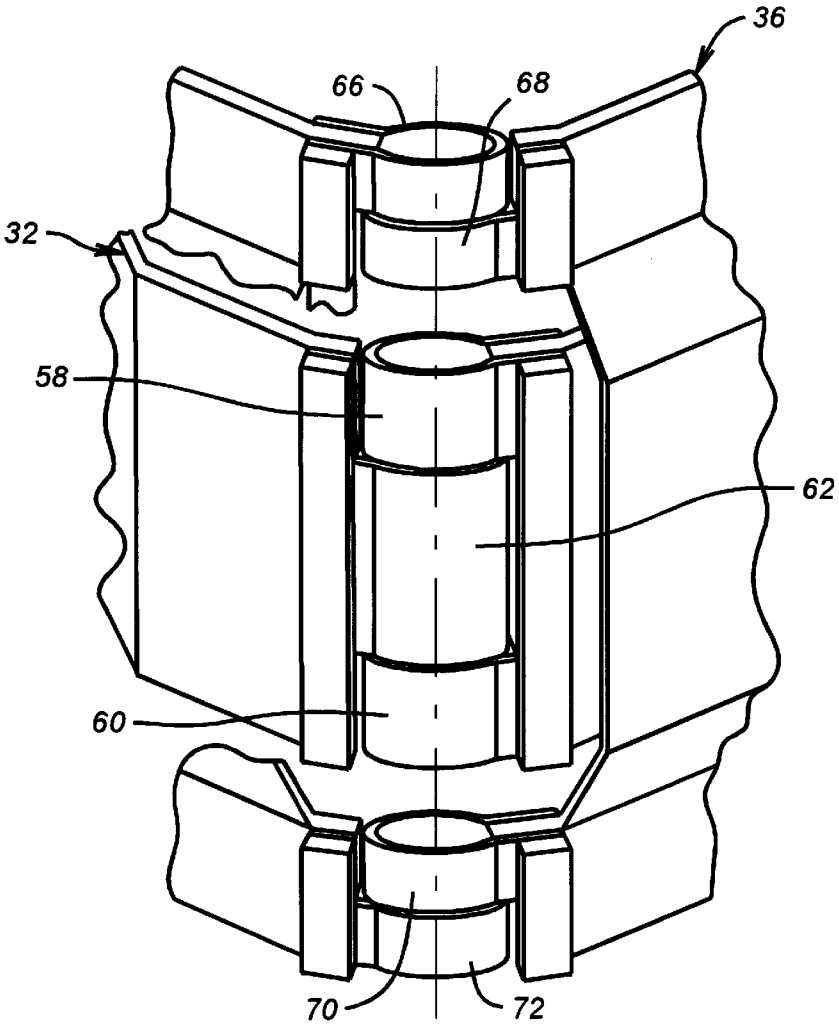
FIG. 3 is an elevational view of the latch assembly with all the loops in alignment prior to insertion of the pin.
Figure 5:
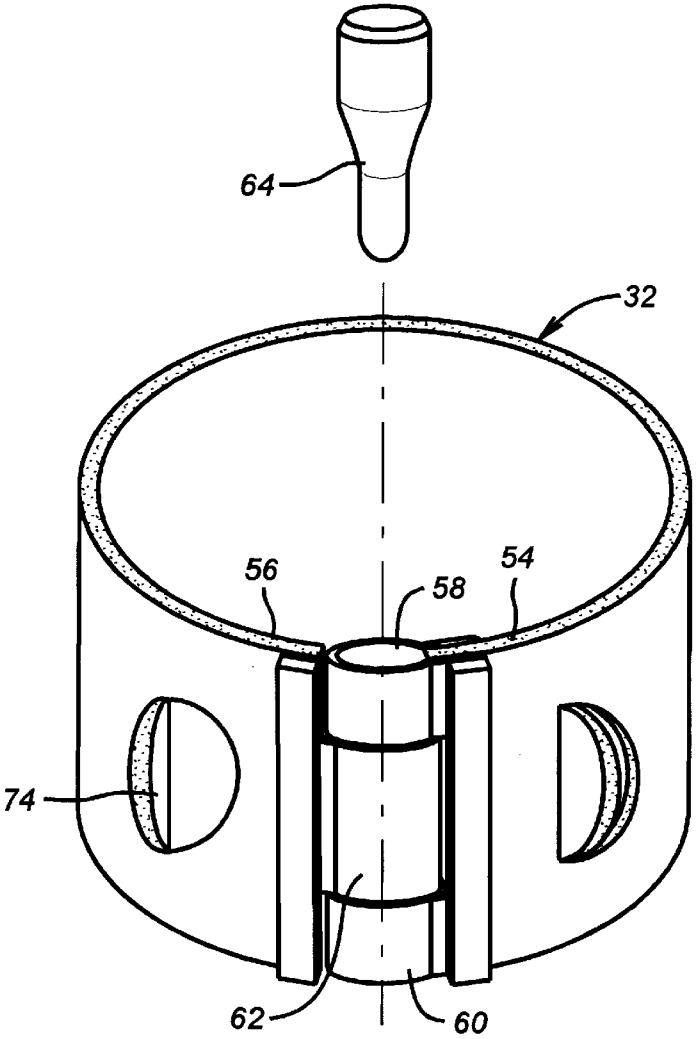
FIG. 5 is a perspective view of the inner part by which the inner part is only the cage by itself, showing bent tabs designed for enhancement of maintaining the relative positions of the inner and outer parts when reacting to applied torsional loads.

As indicated in FIG. 5, the inner cage 32 can be completely cylindrically shaped or it can be made from a series of panels, as shown in FIG. 2. Referring to FIG. 5, the inner cage 32 further comprises ends 54 and 56. End 54 has an upper loop 58 and a lower loop 60. End 56 has a central loop 62. As shown in FIG. 5, loops 58, 60, and 62 are aligned for ultimate insertion of a pin 64, shown schematically in FIG. 5. However, the cages 32 and 36 are nested, as illustrated in FIG. 2. Thus, pin 64 enters not only aligned loops 58, 60, and 62 but also, at the same time, enters other loops that are on the outer cage 36, as illustrated in FIG. 3. As seen in FIG. 3, loops 58, 60, and 62 are in the middle of the assembly on the inner cage 32. The outer cage 36 has a pair of upper loops 66 and 68 and a pair of lower loops 70 and 72. As shown in FIG. 3, all of the loops are in vertical alignment to allow the pin 64 to be inserted therethrough to secure the protector P to the drillpipe. Other configurations of cages 32 and 36 are within the purview of the invention. Thus, if one cage is stronger and applies the majority of the radial force to retain the protector P in the presence of another cage, it is within the purview of the invention.

Figure 4:
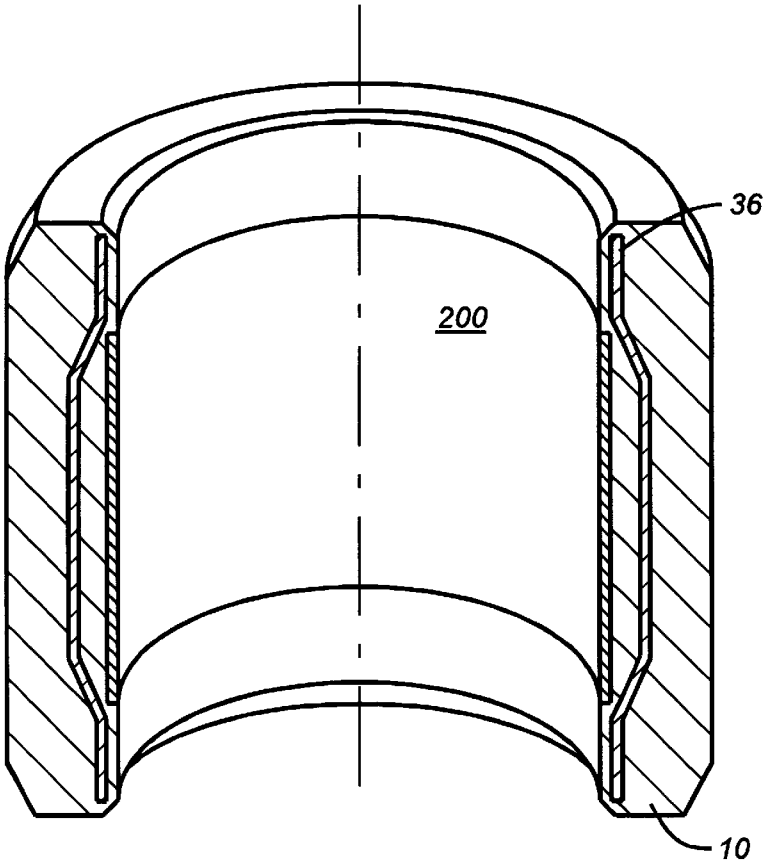
FIG. 4 is an alternative embodiment to FIG. 1, showing a sectional elevational view of the inner and outer part by which the inner part is only the cage by itself.

The rounded design of the cage 32 is illustrated in FIGS. 1 and 4. As shown in FIGS. 4 and 5, the inner part of the protector P can be exclusively the cage 32 for itself. The cage 32 can also have tabs, such as 74, which can be bent outwardly so that they intrude into the resilient material which makes up sleeve 10. The tabs 74 or other attachments extend outwardly toward the outer cage 36. The nesting relationship between the inner cage 32 and the outer cage 36 is seen in FIG. 4. The inner cage 32 is substantially stronger than the components of outer cage 36 due to thicker or higher yield material, which can be also a much higher elastic-plastic elongation material. The bulk majority of the hoop stress and radial force over the circumference and, therefore, the slip force exerted on the drillpipe from the protector P occurs through the inner sleeve 20 originated through the inner cage 32. In the embodiment shown in FIG. 1, the inner cage 32 is separately embedded in inner sleeve 20. On one side of FIG. 1, an optional elastomeric layer 76 is illustrated. If such a layer 76 is to be used, it can go substantially around the circumference of the protector P, or can be installed in sections so that it could further help to increase the coefficient of friction between the protector P and the drillpipe. The elastomeric coating or other coatings can be used in the manner shown in FIG. 1 or, alternatively, in the embodiment shown in FIG. 4. The inner cage 32, which is exposed to the drillpipe in the embodiment of FIG. 4, can have a surface treatment 200 on it that will aid in increasing the frictional force between the cage 32 and the drillpipe without, at the same time, creating damage to the outer surface of the drillpipe due to abrasion.

Figure 6:
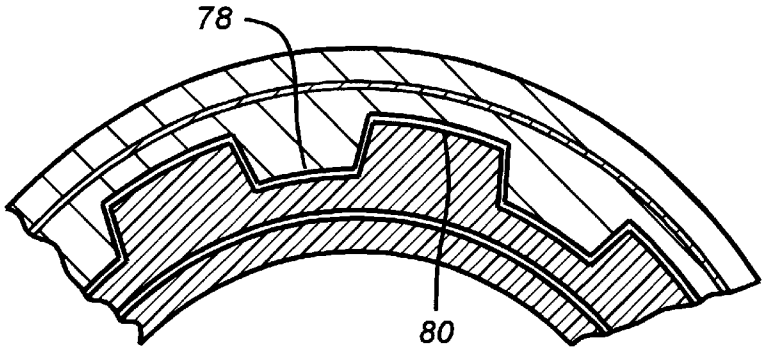
FIG. 6 is a section along lines 6—6 of FIG. 1.

In the configuration of FIG. 1, the inner sleeve 20 can be interlocked with the outer sleeve 10 by a series of alternating projections 78 and 80, as illustrated in FIG. 6. The same concept can also be incorporated to the design of FIG. 4.

Figure 7:
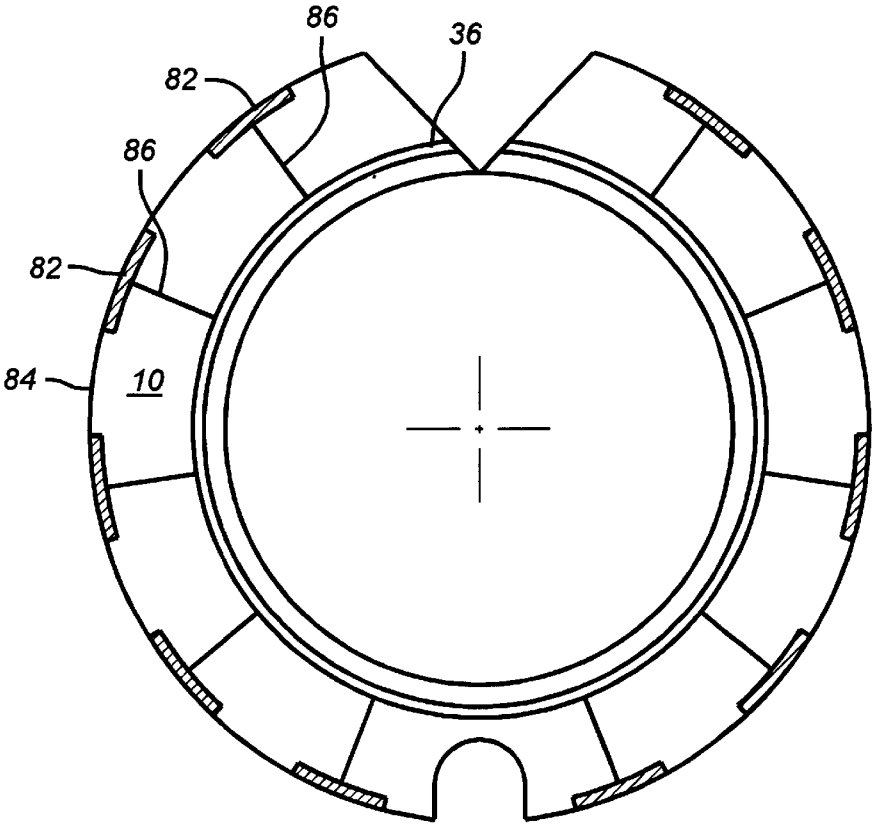
FIG. 7 is a transverse sectional view of the protector showing the possible location of wear pads at its periphery.
Figure 9:
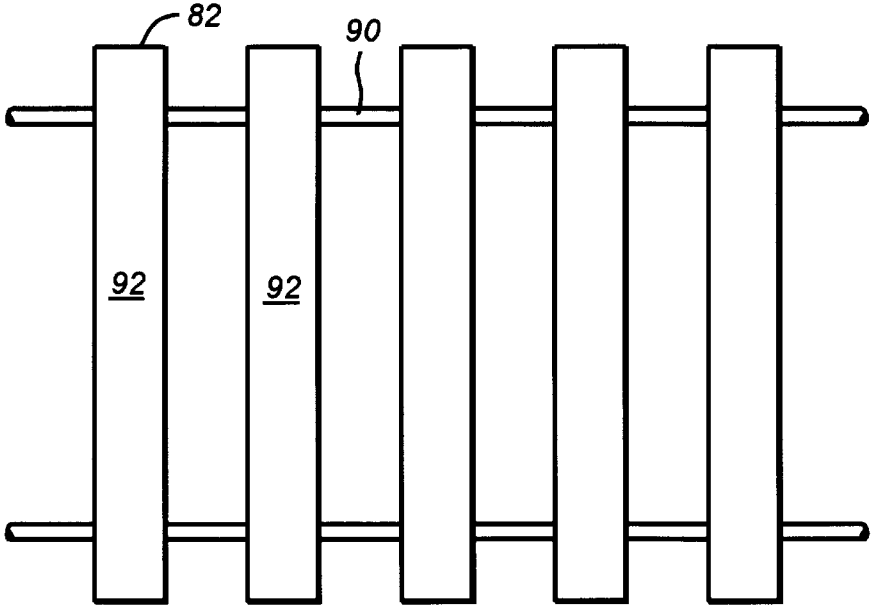
FIG. 9 is an elevational view of the wear pads showing how they are connected to each other for placement within the mold.
Figure 8:
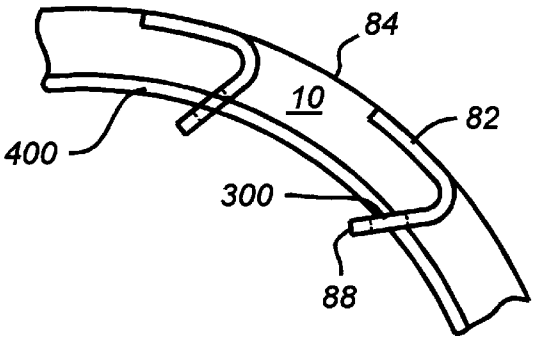
FIG. 8 is an alternative design of wear pads to those shown FIG. 7.

Referring now to FIG. 7, a top view is disclosed that shows a series of wear pads 82 aligned with the outer periphery 84 of outer sleeve 10. To better secure the wear pads 82 to the outer sleeve 10, wires, ties, or fixtures 86 can be used between the wear pads 82 and the outer cage 36 during the molding process. An alternative design is shown in FIG. 8, where the wear pads 82 are manufactured of bent metallic material, having an end 88 extending as far as the outer cage 36. The ends 88 have holes 300 so that they can be fastened together and held in position by a fixture or rope 400 such that there is an alignment with the outer periphery 84 of the outer sleeve 10. FIG. 9 illustrates a flattened out view of the wear pads 82. This time they are secured by a loop or rope 90 which holds them in place within the mold such that the wear faces 92 are in substantial alignment with the outer periphery 84 of outer sleeve 10.

Figure 10:
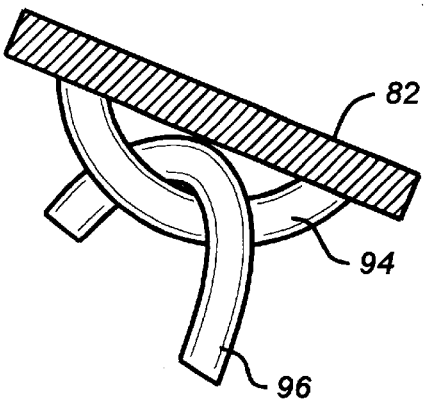
FIG. 10 shows a detailed and alternative way to attach an exterior wear pad to the outer cage.
Figure 12:
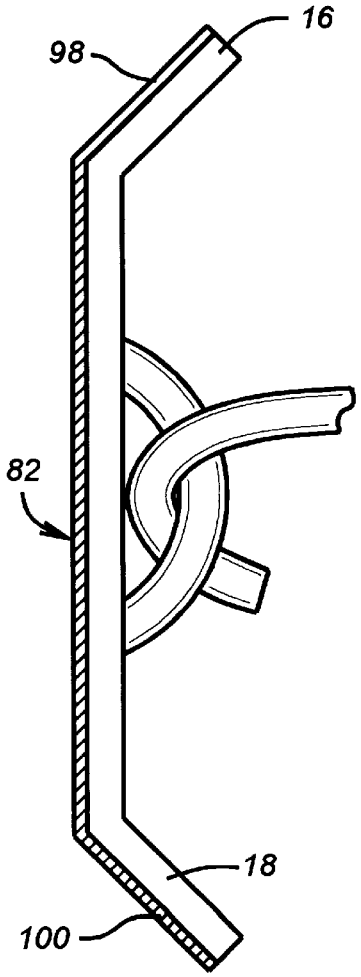
FIG. 12 shows the attachment technique illustrated in FIG. 10 with a wear pad design that bends above and below the main working face of the protector.

FIG. 10 illustrates a loop technique to secure an individual wear pad 82. The back of the wear pad 82 has a loop 94. Another loop 96 extends through loop 94 and is secured to the outer cage 36, as previously described. A similar technique is shown in FIG. 12 except the wear pad 82 wraps around tapered surfaces 16 and 18, with corresponding tapered components 98 and 100, respectively. With the wear pads 82 configured as shown in FIG. 12, the tapered components 98 and 100, respectively, facilitate extraction and insertion of the drillstring with respect to the wellbore. In essence, the tapered components 98 and 100 prevent hanging up of the protector P as the drillstring is being moved axially, thus reducing the risk of breaking off pieces of the outer sleeve 10 or surface BOP equipment on insertion or removal.

Figure 11:
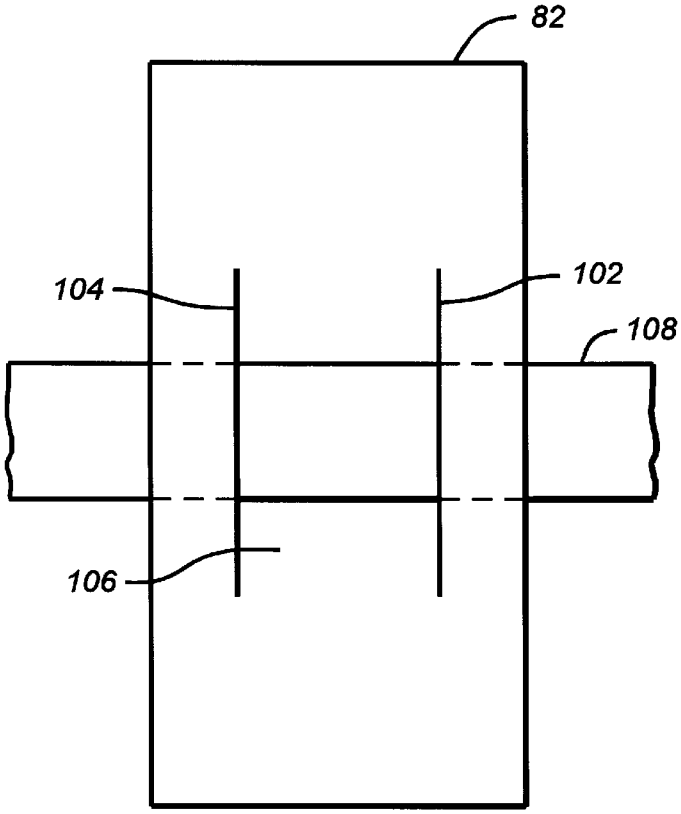
FIG. 11 shows an alternative way of securing the wear pads to each other in a layout of the type as shown in FIG. 9.

FIG. 11 illustrates a wear pad 82, which has a series of parallel punches 102 and 104 creating a depressed segment 106 between the punches sufficient to allow transverse insertion of a band, rope, or fixture 108 to secure the position of the wear pads 82 within the mold, so that when the outer sleeve 10 is produced, the wear pads 82 are secured in the outer periphery 84 of the outer sleeve 10.

The design now having been fully described, it can easily be seen why the protector of the present invention affords the benefits of higher hoop stresses and radial force over the circumference and, therefore, higher slip force for securement of the protector P, while at the same time facilitating a design which can be assembled over the drillpipe with relative ease. A significant portion of the hoop stress and radial force over the circumference and, therefore, the slip force on the pipe is from the fairly short, but relatively stronger, inner cage 32. Thus, while, for example, thickness increases in order to be able to increase the hoop stress and radial force over the circumference and, therefore, to increase the slip force placed on the drillpipe, the overall length of the inner cage 32 is substantially shorter than the single cage designs used in the past. The composite designs, as illustrated in FIGS. 1 and 4, protect the inner sleeve 20 and, therefore, the inner cage 32 from shock loads because the outer sleeve 10 with the outer cage 36 absorbs the impact and disperses them before the force reaches the inner cage 32. By alignment of the various loops between the outer cage 36 and the inner cage 32, the two cages are secured with relation to each other. The outer cage 36 can also take up some of the load in the applied hoop stress and radial force over the circumference and, therefore, the slip force on the drillpipe which secures the protector P to the drillpipe.

The materials of the outer and inner sleeves 10 and 20, shown in FIG. 1, can be varied depending on the thermal and chemical environment in the particular well. The life of the protector can also be increased by the use of the wear pads in the various configurations illustrated in FIGS. 7–12. The bonding effect between the inner cage 32 and the outer sleeve 10 can be enhanced using the punched out tabs 74, as illustrated in FIG. 5. Thus, with the design as illustrated in FIGS. 1 and 4, the hoop stress and radial force over the circumference and, therefore, the slip force can be increased without having to resort to a hinged joint. The protector P as illustrated in the various embodiments is far more economical to manufacture than prior designs and will more reliably stay in one position than those previous designs using a single cage. Additionally, the limitations of prior single-cage designs using the fluted and opening design, which suffered from stress concentration fractures at the fluted bends and openings, is eliminated from this design. The shorter but stronger inner cage 32 desirably accomplishes the increase in hoop stress and radial force over the circumference and, therefore, the increase in slip force required to secure the protector P, without dramatically increasing the drive force required to insert the pin 64 in the aligned loops 58, 60, 62, 66, 68, 70, and 72, as shown in FIG. 3.

As an example, for a 5" drillpipe, the inner cage 32 can be approximately 2.5" high and 0.08"–0.10"thick, while the outer cage 36 has an overall height of 6" and an thickness of 0.02"–0.03". The nesting effect between the elements 10 and 20 also keeps the protector P as a cohesive hold apart from the pin 64 extending through all the aligned loops of the inner and outer cages 32 and 36, respectively.

The foregoing disclosure and description of the invention are illustrative and explanatory thereof, and various changes in the size, shape and materials, as well as in the details of the illustrated construction, may be made without departing from the spirit of the invention.

I claim:

1. A tubular protector for use in a wellbore, comprising:

at least one sleeve having an outer face for contact with the wellbore;

a first cage mounted to said sleeve;

a second cage on said sleeve providing at least a majority of the force that holds the protector to the tubular:

said sleeve has an annular shape with a segment omitted;

said cages extend circumferentially into said omitted segment; and said cages are securable in tandem in said omitted segment.

2. The protector of claim 1, wherein:

said sleeve has at least one wear pad on an outer face thereof.

3. The protector of claim 1, further comprising:

an outer sleeve comprising said outer face for contact with the wellbore;

an inner sleeve between said outer sleeve and the pipe over which the protector is mounted;

said first cage mounted on said outer sleeve and said second cage mounted on said inner sleeve.

4. The protector of claim 3, wherein:

said second cage is substantially thicker than said first cage to allow said second cage to apply a significant portion of the total force on the pipe to hold the protector in place.

5. The protector of claim 4, wherein:

said second cage has an internal surface which has a treatment on it to enhance its ability to be secured to the pipe.

6. The protector of claim 5, wherein:

said outer sleeve has at least one wear pad on an outer face thereof.

7. The protector of claim 6, wherein:

said wear pad is secured to said first cage.

8. The protector of claim 7, wherein:

said wear pad conforms to the outer shape of said outer sleeve on an upper and lower tapers separated by a wear face substantially parallel to the wellbore, whereupon said wear pad facilitates axial movement of the protector with the pipe in the wellbore.

9. A tubular protector for use in a wellbore, comprising:

at least one sleeve having an outer face for contact with the wellbore;

a first cage mounted to said sleeve;

a second cage on said sleeve providing at least a majority of the force that holds the protector to the tubular;

said second cage is mounted between said first cage and the pipe, said second cage is longitudinally shorter than said first cage and is substantially nested in said first cage;

said first cage extends substantially over the longitudinal length of said sleeve and is substantially embedded in said sleeve.

10. The protector of claim 9, wherein:

said sleeve has an annular shape with a segment omitted;

said cages extend circumferentially into said omitted segment;

said cages are securable in tandem in said omitted segment.

11. The protector of claim 10, wherein:

said cages end in loops that can be aligned in said omitted segment of said sleeve, whereupon a pin can be inserted in said aligned loops to secure the protector to the pipe.

12. The protector of claim 9, wherein:

said first or second cages comprise at least one attachment which extends into said sleeve.

13. The protector of claim 9, wherein:

said second cage is substantially stronger than said first cage to allow said second cage to apply a significant portion of the total force on the pipe to hold the protector in place.

14. The protector of claim 9, wherein:

said second cage has an internal surface which has a treatment on it to enhance its ability to grip the pipe.

15. The protector of claim 9, wherein:

said second cage is substantially thicker than said first cage to allow said second cage to apply a significant portion of the total force on the pipe to hold the protector in place.

16. A tubular protector for use in a wellbore, comprising:

at least one sleeve having an outer face for contact with the wellbore;

a first cage mounted to said sleeve;

a second cage on said sleeve providing at least a majority of the force that holds the protector to the tubular:

said sleeve has at least one wear pad on an outer face thereof; and said wear pad is secured to said first cage.

17. The protector of claim 16 wherein:

said wear pad conforms to the outer shape of said sleeve on an upper and lower tapers separated by a wear face substantially parallel to the wellbore, whereupon said wear pad facilitates axial movement of the protector with the pipe in the wellbore.

18. A tubular protector for use in a wellbore, comprising:

at least one sleeve having an outer face for contact with the wellbore;

a first cage mounted to said sleeve;

a second cage on said sleeve providing at least a majority of the force that holds the protector to the tubular;

an outer sleeve comprising said outer face for contact with the wellbore;

an inner sleeve between said outer sleeve and the pipe over which the protector is mounted;

said first cage mounted on said outer sleeve and said second sleeve cage mounted on said inner sleeve; and said first cage extends substantially over the longitudinal length of said outer sleeve and is substantially embedded in said outer sleeve and said second cage is longitudinally shorter than said outer cage and is substantially embedded in said inner sleeve.

19. The protector of claim 18, wherein:

said second sleeve is substantially embedded in said first sleeve.

20. The protector of claim 19, wherein:

said sleeves have an annular shape with a segment omitted;

said cages extend circumferentially into said omitted segment;

said cages are securable in tandem in said omitted segment said sleeves are interlocked with each other against rotation by a series of opposed projections and depressions at their interface.

21. The protector of claim 20, wherein:

said cages end in loops that can be aligned in said omitted segment of said sleeves, whereupon a pin can be inserted in said aligned loops to secure the protector to the pipe.

* * * * *